US006105726A

United States Patent [19]

Taylor et al.

[11] Patent Number: 6,105,726

[45] Date of Patent: Aug. 22, 2000

[54] VARIABLE-INCLINE RAMP SYSTEM FOR HORIZONTAL VEHICLE

[75] Inventors: Roger Taylor, 6263-186A Street, Surrey, British Columbia, Canada, V3S 7N7; Lorne Walters, Langley, Canada

[73] Assignee: Roger Taylor, Surrey, Canada

[21] Appl. No.: 09/060,760

[22] Filed: Apr. 15, 1998

[51] Int. Cl.[7] ..... B66B 9/08

[52] U.S. Cl. ..... 187/201; 187/245

[58] Field of Search ..... 187/200, 201, 187/239, 245, 270; 414/921, 591, 595

[56] References Cited

U.S. PATENT DOCUMENTS

| | | | |
|---|---|---|---|
| 4,026,388 | 5/1977 | Creissels | 187/14 |
| 4,280,593 | 7/1981 | Moore | 187/12 |
| 4,821,845 | 4/1989 | DeViaris | 187/12 |
| 4,957,189 | 9/1990 | Tanaka | 187/12 |

FOREIGN PATENT DOCUMENTS 2171665 3/1996 Canada .

*Primary Examiner*—Kenneth W. Noland

*Attorney, Agent, or Firm*—Christensen O'Connor Johnson & Kindness PLLC

[57] ABSTRACT

A variable-incline ramp system guides a vehicle through the incline between a first site and a second site while at all times maintaining the vehicle in its natural horizontal orientation. The ramp system includes a separate set of rails for guiding the front and the rear wheels of the vehicle. In profile, the two sets of rails form a parallelogram having one pair of sides of a length equal to the wheelbase of the vehicle. So long as these parallelogram sides are horizontally oriented, the vehicle traveling along the rails will maintain its normal orientation because its wheelbase axis will be parallel to the horizontal sides of the parallelogram. In one embodiment suited for use in marine settings, the rails are movably connected to the first and second sites such that as the site elevations change, the parallelogram is free to skew while still remaining a parallelogram with the same length sides.

8 Claims, 4 Drawing Sheets

VARIABLE-INCLINE RAMP SYSTEM FOR HORIZONTAL VEHICLE

FIELD OF THE INVENTION

The present invention relates to a variable-incline ramp system for guiding a vehicle through the incline while at all times maintaining the vehicle in its natural horizontal orientation. More particularly, the invention relates to such a system for providing persons in wheelchairs and similar devices with access to marinas and other sites.

BACKGROUND OF THE INVENTION

Simple ramps are widely used to ease passage between two sites at different elevations. Ramps provide both a continuous surface and a mechanical advantage to ease the movement of heavy loads and vehicles including wheelchairs.

Unfortunately, many sites present challenges to installing a simple ramp. For example, some site pairs lie close together on the plane but at significantly different elevations. In such cases, a simple ramp might have an uncomfortably steep incline that is difficult to traverse. Ramps linking a boat dock to the shore present a particular challenge because the ramp incline varies continuously, and often widely, with changing water level. Similarly, ramps linking a terminal to ships, airplanes, trucks, or other vessels must be readjusted to the position and elevation appropriate for each such vessel.

A number of more complicated powered devices and systems have been proposed to help move people or materials between two sites while maintaining the people or materials in their natural orientation, unaffected by ramp incline.

For example, U.S. Pat. No. 4,026,388, granted to Denis C. Creissels on May 31, 1977 for an "Inclined Lift," describes a horizontal platform that is winched along an inclined track. The Creissels system suffers from a number of disadvantages. Most importantly, whenever the track incline is changed, the platform must be readjusted to preserve its horizontal orientation. The Creissels system is therefore not well suited for variable-incline uses such as at a boat dock. A second disadvantage is that the winch mechanism renders the system essentially an elevator and therefore necessitates the attendant rigorous safety inspections. A simple ramp is generally not considered to present the same safety concerns as an elevator.

U.S. Pat. No. 4,280,593, granted to W. Michael Moore for a "Diagonal Elevator," describes a system in which a conventional elevator winch and counterweight mechanism drives an elevator cage through diagonal guides or tracks. The cage travels along an inclined path but is so adjusted within the tracks as to have a horizontal orientation at all times. Clearly, however, the Moore system suffers from the same disadvantages as were mentioned for the Creissels system.

U.S. Pat. No. 4,821,845, granted on Apr. 18, 1989 to Guy De Viaris for a "Traversing Elevator," discloses a winch and track system for carrying an elevator cage through a continuous series of vertical, diagonal, and horizontal translations, all the while maintaining the cage in a horizontal orientation. The De Viaris system is intriguing; however, it again suffers from similar disadvantages to the Creissels system.

Canadian Patent Application No. 2,171,665, filed by John Edward Ratcliff and Robin Vincent Baker on Mar. 13, 1996 for "Improvements In Platform Lifts," discloses a platform supported on the coupler link of a planar four-bar linkage. The four-bar linkage is shaped as a parallelogram and the frame link is maintained in a horizontal orientation. As the crank and driven links pivot in parallel under the power of a ram, the coupler link, and therefore the platform, are translated through an inclined path, all the while maintaining a horizontal orientation in parallel to the frame link. While the Ratcliff et al. system recognizes the symmetry of the parallelogram, it has significant disadvantages. Structural and material limitations restrict the size and therefore the travel of the four-bar linkage. Further, the mechanism is relatively complex and would likely require the same kind of careful safety inspections as the previously described systems.

What is needed is a ramp system for guiding people and materials through an incline while maintaining them in their natural orientation, unaffected by the incline. The present invention is directed to such a system.

SUMMARY OF THE INVENTION

It is an object of the invention to provide a system for guiding people and materials through an incline while maintaining them in their natural orientation.

The invention can be understood as two parallel ramps, one forward and one rear, separated by a distance equal to the wheelbase of a vehicle and so arranged that the vehicle can simultaneously engage the front ramp with its front wheels and the rear ramp with its rear wheels for travel along both ramps at once. If the two ramps are connected at top and bottom with horizontal members, one can clearly see that the ramps and the members form a parallelogram. Recalling that the vehicle wheelbase is equal in length to the top and bottom members, one can see that the wheelbase axis will be parallel to the top and bottom members, and will therefore be horizontal itself. The wheelbase axis essentially divides the parallelogram into two sub-parallelograms.

It should be noted that the ramps must be so arranged that they do not block the passage of the vehicle, even while they facilitate simultaneous engagement of the front and rear wheels.

According to one aspect of the invention there is provided a ramp system for guiding a vehicle through the incline between a first site and a second site while maintaining the vehicle in a desired orientation, the vehicle having first and second traction mechanisms that define between them a vector parallel to the plane over which the vehicle travels, the system comprising: a first member extending from the first site to the second site and adapted to be engaged by the first traction mechanism, the first member having a first end and a second end, the first end engaging the first site and, the second end engaging the second site, and a second member, parallel to the first member, extending from the first site to the second site and adapted to be engaged by the second traction mechanism, the second member having a first end and a second end, the first end engaging the first site such that the first end of the first member and the first end of the second member define between them a first vector and are spaced apart by a distance equal to the separation between the first and second traction mechanisms, and the second end engaging the second site such that the second end of the first member and the second end of the second member define between them a second vector and are spaced apart by a distance equal to the separation between the first and second traction mechanisms, whereby the first and second members encourage the vehicle to travel along a path parallel therewith and the vehicle vector is parallel to the first and second vectors.

The first end of the first member might engage the first site through a first horizontal member adapted to be engaged by the first traction mechanism, and the first end of the second member might engage the first site through a second horizontal member adapted to be engaged by the second traction mechanism.

The engagement between the first member and the first horizontal member might permit rotation about an axis normal to both the first member and the first horizontal member, and the engagement between the second member and the second horizontal member might permit rotation about an axis normal to both the second member and the second horizontal member.

The second end of the first member and the second end of the second member might engage the second site through a carriage operable to slide over the second site in a direction parallel to the first and second horizontal member. The engagement between the first member and the carriage might permit rotation about an axis parallel to the axis of rotation at the engagement between the first member and the first horizontal member, and the engagement between the second member and the carriage might permit rotation about an axis parallel to the axis of rotation at the engagement between the second member and the second horizontal member. The carriage might slide over the second site along a railbed.

The ramp system might further include: a first transition member extending from the second end of the first member to the second site and adapted to be engaged by the first traction mechanism, the first transition member having a first end and a second end, the first end engaging the second end of the first member and, the second end slideably engaging the second site, and a second transition member, parallel to the first transition member, extending from the second end of the second member to the second site and adapted to be engaged by the second traction mechanism, the second transition member having a first end and a second end, the first end engaging the second end of the second member such that the first end of the first transition member and the first end of the second transition member define between them a third vector and are spaced apart by a distance equal to the separation between the first and second traction mechanisms, and the second end engaging the slideably second site such that the second end of the first transition member and the second end of the second transition member define between them a fourth vector and are spaced apart by a distance equal to the separation between the first and second traction mechanisms, whereby the first and second transition members encourage the vehicle to travel along a path parallel therewith and the vehicle vector is parallel to the third and fourth vectors.

According to a second embodiment of the invention, there is provided for use with the ramp system, a vehicle comprising: a first traction mechanism, and a second traction mechanism, wherein the first and second traction mechanisms define between them a vehicle vector parallel to the plane over which the vehicle travels. The traction mechanisms might be wheels, or more particularly, wheels with a polyurethane traction surface.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
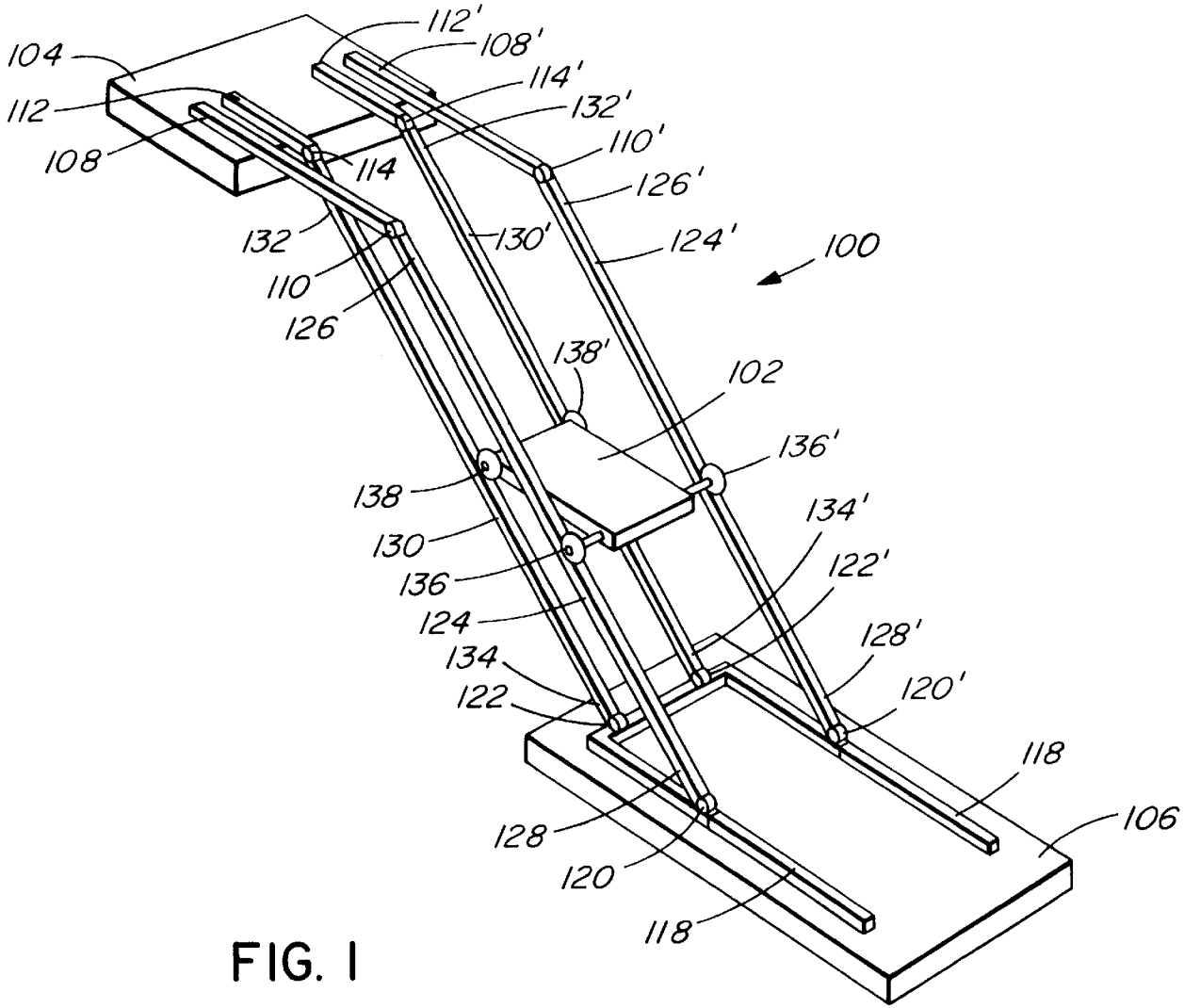
FIG. 1 is a perspective view of a ramp system embodying one aspect of the invention for joining a first site to a second site, the second site being in a first position.
Figure 2:
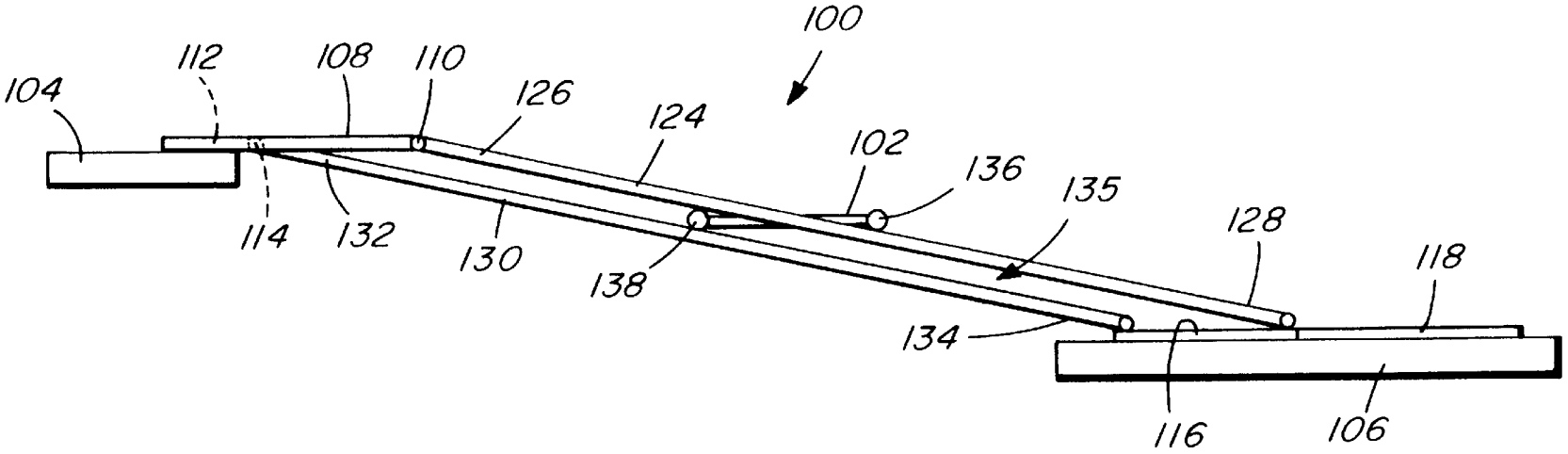
FIG. 2 is a side view of the system of FIG. 1.
Figure 3:
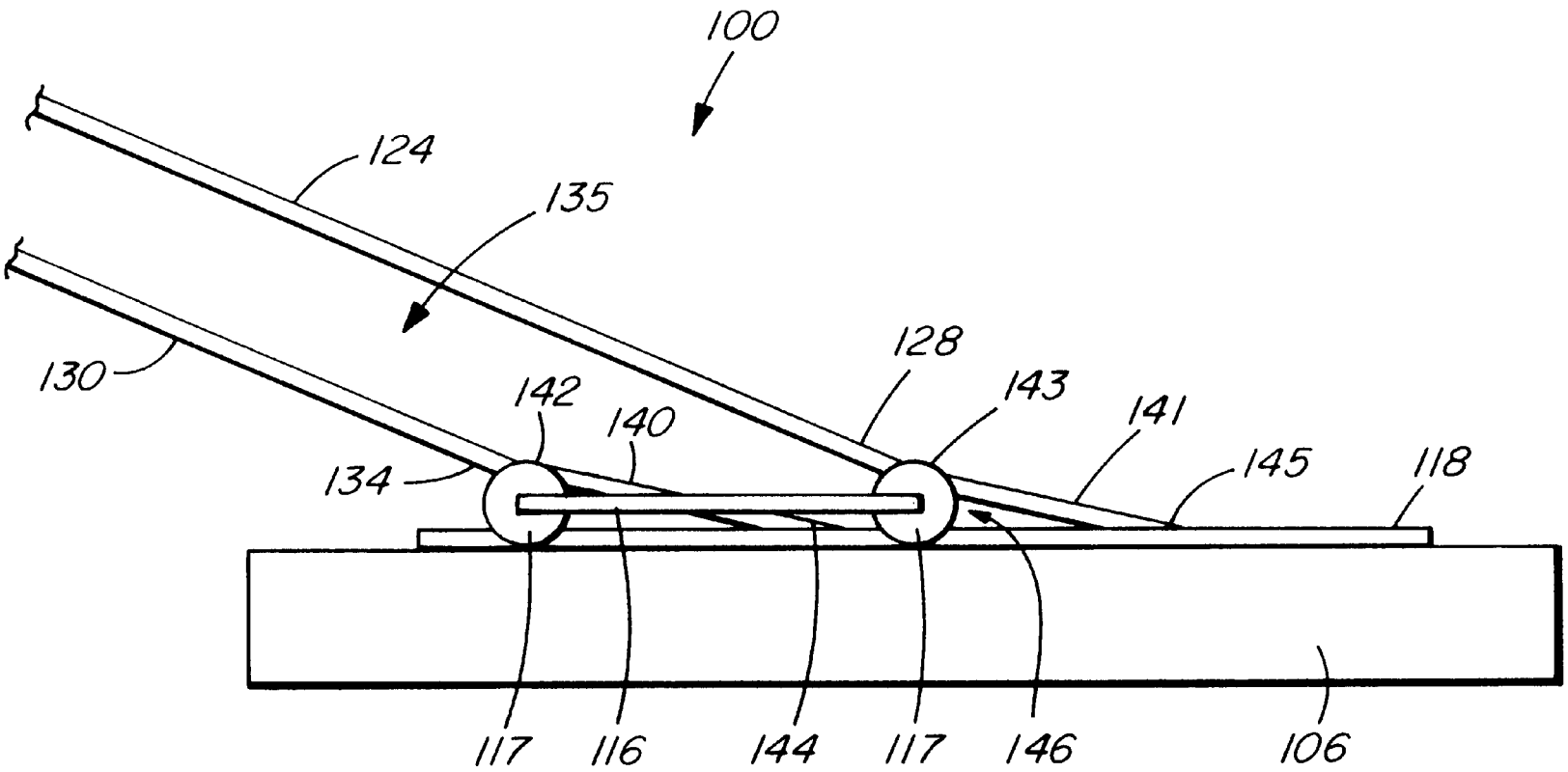
FIG. 3 is a detailed side view of the system of FIG. 1, illustrating the connection of the system to the second site.

With reference to FIGS. 1 through 3, a ramp system embodying one aspect of the invention is generally illustrated at 100. The ramp system 100 conveys a horizontally oriented vehicle 102 from a first site 104 to a second site 106, maintaining the vehicle 102 in its horizontal orientation at all times.

Two forward horizontal rails 108, 108' engage the first site 104, each rail 108, 108' being retained in a horizontal orientation and having a free end 110, 110' extending horizontally from the first site 104. Two rear horizontal rails 112, 112' engage the first site 104, each rail 112, 112' being retained in a horizontal orientation and having a free end 114, 114' extending horizontally from the first site 104 but not so far as the free ends 110, 110' of the forward horizontal rails 108, 108'. The longitudinal axes of the forward 108, 108' and rear 112, 112' horizontal rails are parallel and lie in the same horizontal plane. The two rear horizontal rails 112, 112' are sandwiched between the two forward horizontal rails 108, 108'.

A U-shaped carriage 116 rests on the second site 106, the "U" opening away from the first site 104. The carriage 116 has a set of wheels 117 (FIG. 3) that roll along a railbed 118 affixed to the second site 106. The railbed 118 is graded to define a horizontal plane and encourages the carriage 116 to slide freely parallel to the longitudinal axes of the horizontal rails 108, 108', 112, 112'.

The carriage includes a pair of forward lugs 120, 120' (FIG. 1) having a separation proportionate to the separation of the forward horizontal rails 108, 108' as will be further described below. The forward lugs 120, 120' are equidistant from the free ends 110, 110' of the forward horizontal rails 108, 108' when the carriage 116 is in place on the railbed 118 at the second site 106. The carriage further includes a pair of rear lugs 122, 122' having a separation proportionate to the separation of the rear horizontal rails 112, 112' as will be further described below. The rear lugs 122, 122' are equidistant from the free ends 114, 114' of the rear horizontal rails 112, 112' when the carriage 116 is in place on the railbed 118 at the second site 106. The separation between the forward lugs 120, 120' and the rear lugs 122, 122' is equal to the separation between the free ends 110, 110' of the forward horizontal rails 108, 108' and the free ends 114, 114' of the rear horizontal rails 112, 112'.

Each of a pair of forward inclined rails 124, 124' has a first end 126, 126' and a second end 128, 128'. The first ends 126, 126' of the forward inclined rails 124, 124' pivotally engage the free ends 110, 110' of the forward horizontal rails 108, 108'. The second ends 128, 128' of the forward inclined rails 124, 124' pivotally engage the forward lugs 120, 120' of the carriage 116, the forward lugs 120, 120' being separated such that the forward inclined rails 124, 124' have the same separation as the forward horizontal rails 108, 108'.

Each of a pair of rear inclined rails 130, 130' has a first end 132, 132' and a second end 134, 134'. The first ends 132, 132' of the rear inclined rails 130, 130' pivotally engage the free ends 114, 114' of the rear horizontal rails 112, 112'. The second ends 134, 134' of the rear inclined rails 130, 130' pivotally engage the rear lugs 122, 122' of the carriage 116, the rear lugs 122, 122' being separated such that the rear inclined rails 130, 130' have the same separation as the rear horizontal rails 112, 112'.

So connected, in profile the horizontal rails 108, 108', 112, 112', the carriage 116, the forward inclined rails 124, 124', and the rear inclined rails 130, 130' form a first parallelogram 135 with vertices that pivot in coordination.

The vehicle 102 has a pair of forward wheels 136, 136' for engaging the forward horizontal rails 108, 108' and the forward inclined rails 124, 124'. The separation between the forward wheels 136, 136' is equal to the separation between the forward rails 108, 108', 124, 124'. The vehicle 102 has a pair of rear wheels 138, 138' for engaging the rear horizontal rails 112, 112' and the rear inclined rails 130, 130'. The separation between the rear wheels 138, 138' is equal to the separation between the rear rails 112, 112', 130, 130'.

The wheelbase of the vehicle 102 is equal to the separation between the forward lugs 120, 120' and the rear lugs 122, 122' on the carriage 116 and the separation between the free ends 110, 110' of the forward horizontal rails 108, 108' and the free ends 114, 114' of the rear horizontal rails 112, 112'. Therefore when the wheels 136, 136', 138, 138' engage the inclined rails 124, 124', 130, 130', the vehicle 102 plane defined by the centers of the wheels 136, 136', 138, 138' will at all times be parallel to the horizontal rails 108, 108', 110, 110' and the horizontal carriage 116 so long as the wheels 136, 136', 138, 138' have the same diameter. If the wheels 136, 136', 138, 138' have different diameters, the planes will be misaligned by a constant angle which may be compensated for.

Where the carriage 116 wheels 117 are so large that they create a significant gap between the second site 106 and the second ends 128, 128', 134, 134' of the inclined rails 124, 124', 130, 130', a set of four short, equal length transition rails 140 (FIG. 3), 141 is added to close the gap. Only the transition rails 140, 141 nearer the viewer are visible in FIG. 3, but there are corresponding transition rails aligned with rails 124' and 130'. Each transition 140, 141 rail has a first end 142, 143 that pivotably engages the carriage lugs 120, 120', 122, 122' and a second end 144, 145 that slides freely over the second site 106.

So connected, in profile the carriage 116, the railbed 117 and the transition rails 140, 141 form a second parallelogram 146 with vertices that pivot in coordination. As described above, when the wheels 136, 136', 138, 138' engage the transition rails 140, 141, the vehicle 102 plane defined by the centers of the wheels 136, 136', 138, 138' will at all times be parallel to the carriage 116 and the railbed 117 which are both horizontal so long as the wheels 136, 136', 138, 138' have the same diameter.

Figure 4:
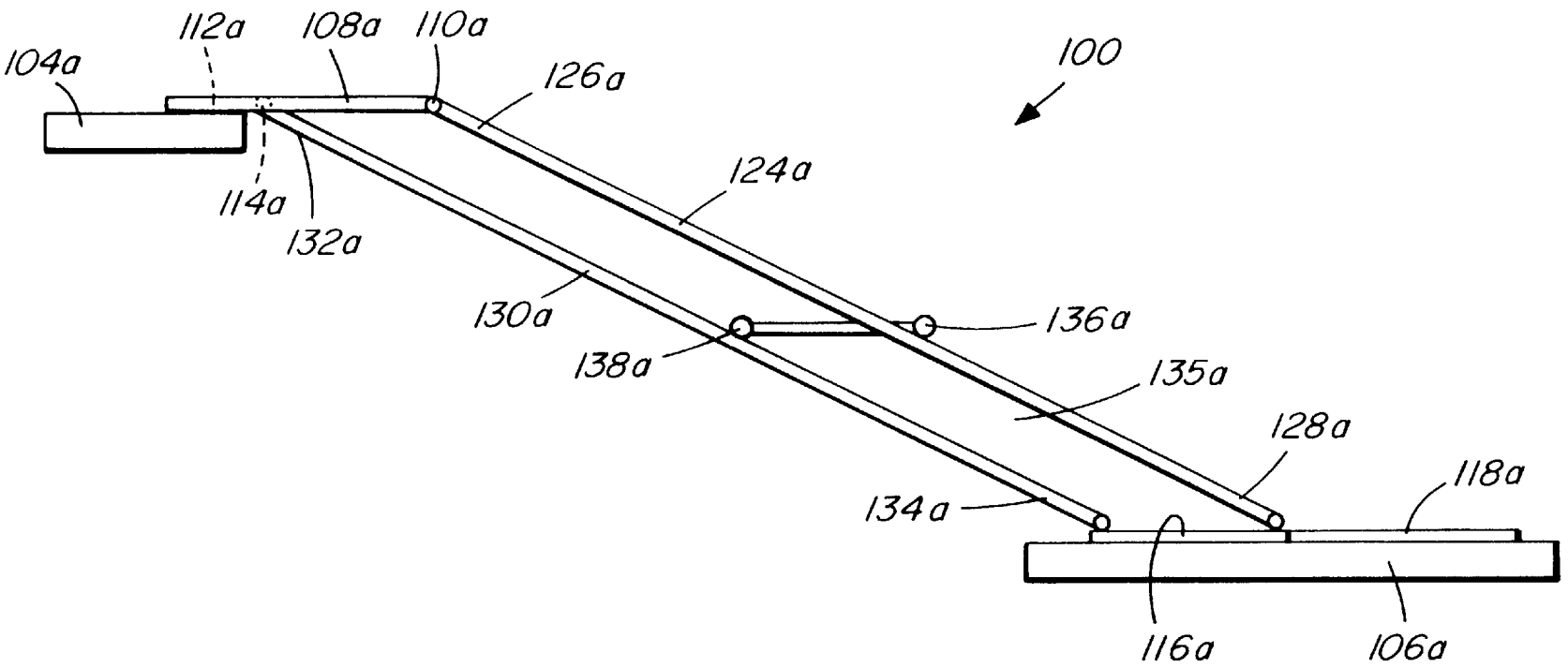
FIG. 4 is a side view of the system of FIG. 2 with the second site in a second position.

With reference now to FIG. 4, the ramp system 100 is illustrated after the second site 106*a* has transformed to a lower elevation, perhaps as a result of a change of water level. It will be noted that the transformed first parallelogram 135*a* has skewed from the original first parallelogram 135, but that it is still a parallelogram and the lengths of its sides are unchanged. It will also be noted that the transformed horizontal rails 108*a*, 108*a'*, 112*a*, 112*a'* are identical to the original horizontal rails 108, 108', 112, 112'; however, the transformed carriage 116*a*, although still horizontal, has translated to a different position in the horizontal plane from that occupied by the original carriage 116.

Although not illustrated, the same type of transformation occurs with respect to the second parallelogram 146.

In operation, the vehicle 102 may be stored at either the first site 104 or the second site 106. A person wishing to travel from the first site 104 to the second site 106 drives the vehicle 102 such that the forward wheels 136, 136' engage the forward horizontal rails 108, 108' and the rear wheels 138, 138' engage the rear horizontal rails 112, 112'.

He continues driving the vehicle 102 along the horizontal rails 108, 108', 112, 112' until the forward wheels 136, 136' engage the forward inclined rails 124, 124' and the rear wheels 138, 138' engage the rearward inclined rails 130, 130'. As the person drives the vehicle 102 along the inclined rails 124, 124', 130, 130', the vehicle 102 plane defined by the centers of the wheels 136, 136', 138, 138' is at all times parallel to the horizontal rails 108, 108', 112, 112' and the horizontal U-shaped carriage 116. The vehicle 102 is therefore at all times horizontal as it would be on any horizontal stretch of roadway.

When the vehicle 102 reaches the second end 128, 128', 134, 134' of the inclined rails 124, 124', 130, 130', the vehicle 102 wheels 136, 136', 138, 138' might directly engage the second site 106. However, if the U-shaped carriage 116 wheels 117 create too large a gap between the inclined rails 124, 124', 130, 130' and the second site 106, the vehicle 102 first travels along a set of transition rails 140, 141 to reach the second site 106. Upon reaching the second site 106, the vehicle 102 is ready to either proceed or to return to the first site 104 for a similar journey.

If the difference in elevation between the first site 104 and the second site 106 changes, perhaps due to a change in water level, the inclined rails 124*a*, 124*a'*, 130*a*, 130*a'* and the U-shaped carriage 116*a* shift, thereby skewing but not otherwise deforming the first parallelogram 135*a*. So long as the horizontal rails 108*a*, 108*a'*, 112*a*, 112*a'* and the carriage 116*a* remain horizontal, the vehicle 102 plane defined by the centers of the wheels 136, 136', 138, 138' remains horizontal when the wheels 136, 136', 138, 138' engage the inclined rails 124, 124', 130, 130'.

Although a specific embodiment of the present invention has been described and illustrated, the present invention is not limited to the features of this embodiment, but includes all variations and modifications within the scope of the claims.

For example, it should be understood that no more than two rails are necessary. What is important is that the rails form a parallelogram projection having two sides parallel to the desired orientation plane. The invention can be understood as two parallel ramps, one forward and one rear, separated by the wheelbase of a vehicle and so arranged that the vehicle can simultaneously engage the front ramp with its front wheels and the rear ramp with its rear wheels. In this regard, rails might be replaced with ramps that are slotted or otherwise constructed so as not to interfere with the desired vehicle path. It is also envisioned that overhead rails could be used.

It should also be understood that for clarity the rails have been presented as beams. It is expected that trusswork and cross-bracing would be appropriate in many situations. In fact, the system could be made to be self-supporting and portable. It is also envisioned that safety railings could be added without interfering with the rails. Rail pairs might be joined with planking, grilles, lattices, or similar cross-bracing to form a ramp surface for non-rail passage. It should be understood that rails might have a channeled, grooved, crowned, or flat cross-section as necessary to better engage the wheels and that other terms such as tracks, guides, beams, and members, would be similarly applicable when describing the rails.

Although a self-propelled vehicle 102 is preferred, it is easily envisioned that an external propulsion unit such as a winch could be employed. The vehicle 102 might be free to travel both on and off the rails or might be constrained to the rails at one or both sites.

The vehicle wheels are preferably polyurethane but other materials would suffice so long as the junction between wheel and rail was sufficiently frictional to prevent the vehicle from sliding on the rails instead of rolling. To this same end, it is anticipated that the rails might be characterized by a high friction surface to meet the wheels. It should be noted that other rail engagement mechanisms are envisioned, including: rack and pinion gearing, runner and track coupling, or a direct chain drive.

It is further envisioned that the first and second parallelograms need not be transformable at all if the ramp is to remain fixed. The connections of the inclined rails to the sites need not be as indicated; the rails might be fixedly, pivotally, or slidably attached to either site in any of many well-known ways. If it is not intended that the vehicle leave the inclined rails, then horizontal rails need not be included and the inclined rails could be connected directly to the first site.

It should be finally noted that the parallelograms can be aligned to an plane other than the horizontal.

While the preferred embodiment of the invention has been illustrated and described, it will be appreciated that various changes can be made therein without departing from the spirit and scope of the invention.

What is claimed is:

1. A ramp system for guiding a vehicle through the incline between a first site and a second site while maintaining the vehicle in a desired orientation, the vehicle having first and second traction mechanisms that define between them a vector parallel to the plane over which the vehicle travels, the system comprising:

(a) a first member extending from the first site to the second site and adapted to be engaged by the first traction mechanism, the first member having a first end and a second end;

(i) the first end engaging the first site through a first horizontal member adapted to be engaged by the first traction mechanism, and (ii) the second end engaging the second site, and (b) a second member, parallel to the first member, extending from the first site to the second site and adapted to be engaged by the second traction mechanism, the second member having a first end and a second end;

(i) the first end engaging the first site through a second horizontal member adapted to be engaged by the second traction mechanism such that the first end of the first member and the first end of the second member define between them a first vector and are spaced apart by a distance equal to the separation between the first and second traction mechanisms, (ii) the second end engaging the second site such that the second end of the first member and the second end of the second member define between them a second vector and are spaced apart by a distance equal to the separation between the first and second traction mechanisms, whereby the first and second members encourage the vehicle to travel along a path parallel therewith and the vehicle vector is parallel to the first and second vectors; and wherein the engagement between the first member and the first horizontal member permits rotation about an axis normal to both the first member and the first horizontal member, and the engagement between the second member and the second horizontal member permits rotation about an axis normal to both the second member and the second horizontal member.

2. A ramp system as in claim 1, wherein: the second end of the first member and the second end of the second member engage the second site through a carriage operable to slide over the second site in a direction parallel to the first and second horizontal members.

3. A ramp system as in claim 2 wherein:

(a) the engagement between the first member and the carriage permits rotation about an axis parallel to the axis of rotation at the engagement between the first member and the first horizontal member, and (b) the engagement between the second member and the carriage permits rotation about an axis parallel to the axis of rotation at the engagement between the second member and the second horizontal member.

4. A ramp system as in claim 3, wherein: the carriage slides over the second site along a railbed.

5. A ramp system as in claim 4, further comprising:

(a) a first transition member extending from the second end of the first member to the second site and adapted to be engaged by the first traction mechanism, the first transition member having a first end and a second end:

(i) the first end engaging the second end of the first member and, (ii) the second end slideably engaging the second site, and (b) a second transition member, parallel to the first transition member, extending from the second end of the second member to the second site and adapted to be engaged by the second traction mechanism, the second transition member having a first end and a second end:

(i) the first end engaging the second end of the second member such that the first end of the first transition member and the first end of the second transition member define between them a third vector and are spaced apart by a distance equal to the separation between the first and second traction mechanisms, and (ii) the second end engaging the slideably second site such that the second end of the first transition member and the second end of the second transition member define between them a fourth vector and are spaced apart by a distance equal to the separation between the first and second traction mechanisms, whereby the first and second transition members encourage the vehicle to travel along a path parallel therewith and the vehicle vector is parallel to the third and fourth vectors.

6. For use with the ramp system of claim 1, a vehicle comprising:

(a) a first traction mechanism, and (b) a second traction mechanism wherein, the first and second traction mechanisms define between them a vehicle vector parallel to the plane over which the vehicle travels.

7. A vehicle as in claim 6 wherein the first and second traction mechanisms are wheels.

8. A vehicle as in claim 7 wherein the wheels have a polyurethane traction surface.

* * * * *